US008911054B2

(12) United States Patent
Kitamura et al.

(10) Patent No.: US 8,911,054 B2
(45) Date of Patent: Dec. 16, 2014

(54) IMAGE FORMING APPARATUS

(71) Applicants: Yasukazu Kitamura, Kanagawa (JP); Yoshimitsu Ogura, Kanagawa (JP); Kazuyoshi Matsumoto, Tokyo (JP); Tomoaki Nakano, Kanagawa (JP); Namio Ogihara, Kanagawa (JP); Shingo Masaoka, Kanagawa (JP)

(72) Inventors: Yasukazu Kitamura, Kanagawa (JP); Yoshimitsu Ogura, Kanagawa (JP); Kazuyoshi Matsumoto, Tokyo (JP); Tomoaki Nakano, Kanagawa (JP); Namio Ogihara, Kanagawa (JP); Shingo Masaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/205,865

(22) Filed: Mar. 12, 2014

(65) Prior Publication Data

US 2014/0267487 A1 Sep. 18, 2014

(30) Foreign Application Priority Data

Mar. 15, 2013 (JP) ..... 2013-053296
Oct. 30, 2013 (JP) ..... 2013-226043

(51) Int. Cl.
*B41J 29/38* (2006.01)
*B41J 11/00* (2006.01)

(52) U.S. Cl.
CPC ..... *B41J 11/0095* (2013.01); *B41J 11/009* (2013.01)
USPC ..... 347/16; 347/14; 347/19; 347/104

(58) Field of Classification Search
CPC ..... B41J 11/009; B41J 11/0095; B41J 11/485
USPC ..... 347/14, 16, 19, 101, 104–106
See application file for complete search history.

(56) References Cited

U.S. PATENT DOCUMENTS

| | | | | |
|---|---|---|---|---|
| 6,558,055 | B1 * | 5/2003 | Shishido et al. | 400/248 |
| 6,981,766 | B2 * | 1/2006 | Tsuji | 347/104 |
| 7,654,631 | B2 * | 2/2010 | Takeishi et al. | 347/19 |
| 8,602,516 | B2 * | 12/2013 | Hamada | 347/14 |
| 2010/0149242 | A1 | 6/2010 | Takahashi et al. | |

FOREIGN PATENT DOCUMENTS

| | | |
|---|---|---|
| JP | 7-097132 | 4/1995 |
| JP | 2010-137477 | 6/2010 |

OTHER PUBLICATIONS

U.S. Appl. No. 13/950,473, filed Jul. 25, 2013.
U.S. Appl. No. 13/950,867, filed Jul. 25, 2013.
U.S. Appl. No. 14/027,492, filed Sep. 16, 2013.
U.S. Appl. No. 14/029,016, filed Sep. 17, 2013.
U.S. Appl. No. 14/039,211, filed Sep. 27, 2013.

(Continued)

*Primary Examiner* — Juanita D Jackson
(74) *Attorney, Agent, or Firm* — Cooper & Dunham LLP

(57) ABSTRACT

An image forming apparatus includes an image forming device, a belt member, a reflection-type photosensor, and a reflection member. The belt member includes plural suction holes to attract a printing medium onto the belt member. The reflection member reflects light from the reflection-type photosensor through the suction holes. The reflection member is disposed inside the belt member. The reflection member has a reflection rate at which, when the reflection-type photosensor receives reflection light at positions of the suction holes with a transparent printing medium being not present on the belt member, a sensor output of the reflection-type photosensor is lower than a predetermined reference value, and when the reflection-type photosensor receives reflection light at the positions of the suction holes with the transparent printing medium being present on the belt member, a sensor output of the reflection-type photosensor is equal to or greater than the predetermined reference value.

8 Claims, 7 Drawing Sheets

(56) References Cited
OTHER PUBLICATIONS

U.S. Appl. No. 14/045,931, filed Oct. 4, 2013.

U.S. Appl. No. 14/044,071, filed Oct. 2, 2013.

* cited by examiner

IMAGE FORMING APPARATUS

CROSS-REFERENCE TO RELATED APPLICATIONS

This patent application is based on and claims priority pursuant to 35 U.S.C. §119 to Japanese Patent Application Nos. 2013-053296, filed on Mar. 15, 2013, and 2013-226043, filed on Oct. 30, 2013, in the Japan Patent Office, the entire disclosure of each of which is hereby incorporated by reference herein.

BACKGROUND

1. Technical Field

Embodiments of this disclosure relate to an image forming apparatus.

2. Description of the Related Art

Image forming apparatuses are used as, for example, copiers, printers, facsimile machines, and multi-functional devices having at least one of the foregoing capabilities. As one type of image forming apparatus, an image forming apparatus for label printing, such as a label printer, is known. For such an image forming apparatus, an image forming device performs printing on a printing medium, such as tape or a label sheet without a liner, having an adhesive face with no release paper attached to the adhesive face (hereinafter also referred to as "linerless label sheet"). After printing, the printing medium is cut into pieces of printing medium (hereinafter also referred to as "label pieces") at desired lengths.

Such an image forming apparatus may use a transparent printing medium, such as transparent tape.

To detect a trailing end of the transparent tape, for example, JP-H07-097132-A proposes a transmissive photosensor to sandwich the transparent tape. By detecting a non-transparent portion at a trailing end portion of the transparent tape, the transmissive photosensor detects the trailing end of the tape.

Such an image forming apparatus typically uses a reflection-type photosensor to detect a leading end or width of a printing medium. For conveyance of the printing medium, a suction-type conveyance belt may be used to convey the printing medium while suctioning the printing medium onto the conveyance belt.

For example, in a case in which the printing medium is a transparent tape, when suction holes of a conveyance belt are included in an area detected by the reflection-type photosensor, a difference in the amount of reflection light may occur between the area corresponding to the suction holes and an area other than the suction holes, thus causing false detection.

BRIEF SUMMARY

In at least one exemplary embodiment of this disclosure, there is provided an image forming apparatus including an image forming device, a belt member, a reflection-type photosensor, and a reflection member. The image forming device forms an image on a printing medium. The belt member is movable to circulate. The belt member includes plural suction holes to attract the printing medium onto the belt member. The reflection-type photosensor detects the printing medium on the belt member. The reflection member reflects light from the reflection-type photosensor through the suction holes. The reflection member is disposed inside the belt member. Whether or not a transparent printing medium is present on the belt member is determined by comparing a sensor output of the reflection-type photosensor with a predetermined reference value of presence and absence of the printing medium.

The reflection member has a reflection rate at which, when the reflection-type photosensor receives reflection light at positions of the suction holes with the transparent printing medium being not present on the belt member, the sensor output of the reflection-type photosensor is lower than the predetermined reference value, and when the reflection-type photosensor receives reflection light at the positions of the suction holes with the transparent printing medium being present on the belt member, the sensor output of the reflection-type photosensor is equal to or greater than the predetermined reference value.

In at least one exemplary embodiment of this disclosure, there is provided an image forming apparatus including an image forming device, a belt member, a reflection-type photosensor, and a reflection member. The image forming device forms an image on a printing medium. The belt member is movable to circulate. The belt member includes plural suction holes to attract the printing medium onto the belt member. The reflection-type photosensor detects the printing medium on the belt member. The reflection member reflects light from the reflection-type photosensor through the suction holes. The reflection member is disposed inside the belt member. A difference between a sensor output of the reflection-type photosensor obtained when the reflection-type photosensor receives reflection light from a surface of the belt member and a sensor output of the reflection-type photosensor obtained when the reflection-type photosensor receives reflection light from the reflection member is lower than a difference between the sensor output of the reflection-type photosensor obtained when the reflection-type photosensor receives the reflection light from the surface of the belt member and a sensor output of the reflection-type photosensor obtained when the reflection-type photosensor receives reflection light with the transparent printing medium being present on the belt member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
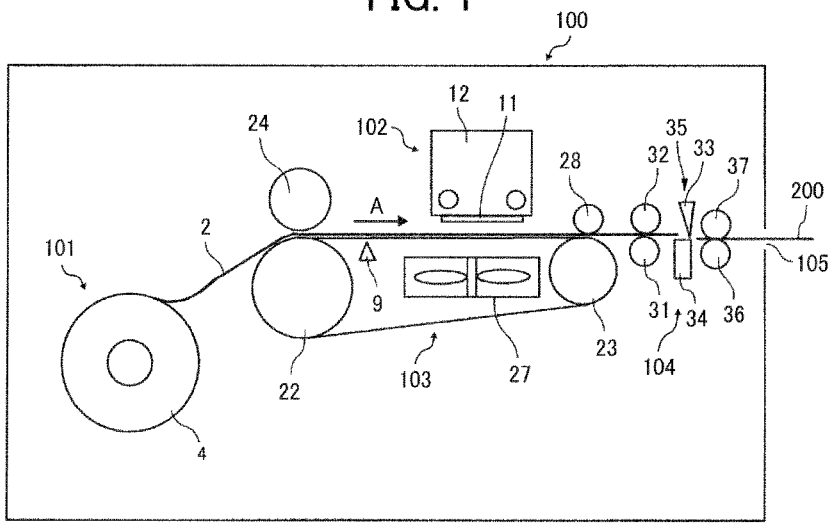
FIG. 1 is a side view of an image forming apparatus according to an embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an embodiment of this disclosure is described below with reference to FIGS. 1 and 2.

Figure 2:
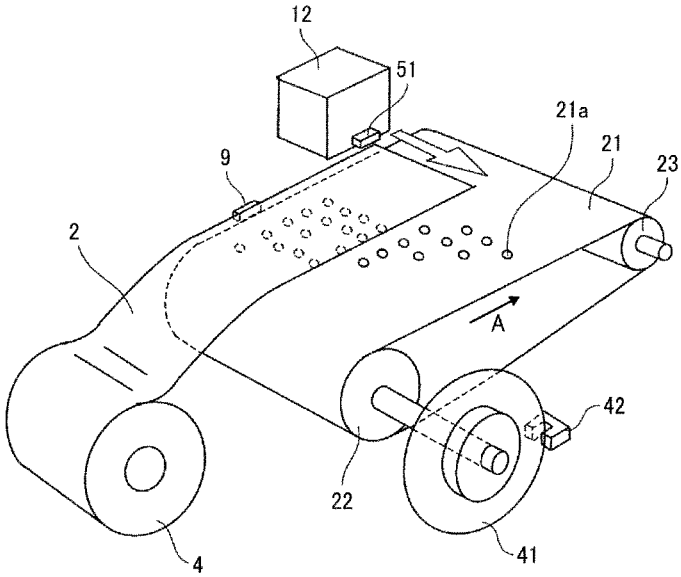
FIG. 2 is a perspective view of the image forming apparatus of FIG. 1.

FIG. 1 is a side view of an image forming apparatus according to an embodiment of this disclosure. FIG. 2 is a perspective view of a portion of the image forming apparatus illustrated in FIG. 1.

In an apparatus body 100, the image forming apparatus includes a feed unit 101, an image forming unit 102 serving as an image forming device, a conveyance unit 103 serving as a conveyance device, and a discharge unit 104 serving as a sheet discharge device.

A printing medium 2, which is a linerless label sheet, is wound around in a roll shape to form a roll body 4, and the roll body 4 is installed into the feed unit 101.

Here, the printing medium 2 is a continuous body in which an adhesive layer (hereinafter referred to as "adhesive face") is formed on a face of the printing medium 2 on which an image can be formed (hereinafter referred to as "printing face"). The roll body 4 is formed by winding the printing medium 2 around into a roll shape without sticking liner (release paper, separator) to the adhesive face 2B of the printing medium 2.

The image forming unit 102 includes a carriage 12 mounting a recording head 11 serving as a liquid ejection head to eject liquid droplets to the printing medium 2. The carriage 12 is supported by a guide member to be reciprocally movable back and forth along a main scanning direction perpendicular to a feed direction (media feed direction indicated by arrow A in FIG. 2) of the printing medium 2.

The recording head 11 is a head having two nozzle rows. In this embodiment, two recording heads 11 are used to eject ink droplets of respective colors, i.e., black (K), cyan (C), magenta (M), and yellow (Y) from four nozzle rows. However, the recording head is not limited to the above-described configuration and, for example, a line-type head can be used.

The image forming unit 102 is not limited to the form of the liquid ejection heads and a different type of image forming devices may be used to carry out contact or non-contact image formation.

As the conveyance unit 103, a protection belt 21 serving as a conveyance belt is disposed below the recording heads 11. The protection belt 21 is an endless belt member and also serves as an adhesive-face protection member. The protection belt 21 is looped over a conveyance roller 22 serving as a rotary body and a follow roller 23 to be able to circulate.

A pressure roller 24 is disposed facing the conveyance roller 22. Paired rotary bodies (here, paired rollers) including the conveyance roller 22 and the pressure roller 24 form the conveyance device to sandwich the printing medium 2 and the protection belt 21, serving as the adhesive-face protection member, together and convey the printing medium 2 and the protection belt 21 to an image formation area in which the recording heads 11 form an image on the printing medium 2. In this embodiment, the printing medium 2 is conveyed with the adhesive face of the printing medium 2 supported on the protection belt 21.

Using the conveyance device prevents a conveyance error due to adhesion of the adhesive face 2*b* on a conveyance path to convey the printing medium or instable conveyance due to an increase in conveyance resistance.

The protection belt 21 has multiple (plural) suction holes 21*a*. A suction fan 27 serving as a suction device to suck the printing medium 2 toward a surface (conveyance face) of the protection belt 21 through the suction holes 21*a* is disposed within a loop of the protection belt 21 to face the recording heads 11 of the image forming unit 102. In this embodiment, the printing medium 2 is attracted to the protection belt 21 by suction. However, the attraction is not necessarily carried out by suction but may be carried out by, e.g., electrostatic force.

Moreover, a spur roller 28 is disposed facing the follow roller 23.

An encoder wheel 41 is mounted to a shaft of the conveyance roller 22, and an encoder sensor 42 to read the encoder wheel 41 forms a sub-scanning encoder.

As the discharge unit 104, an intermediate roller 31 to convey the printing medium 2 sent out from the protection belt 21 and a spur roller 32 facing the intermediate roller 31 are disposed downstream from the protection belt 21 in a conveyance direction of the printing medium 2. A cutter unit 35 serving as a cutting unit is disposed downstream from the intermediate roller 31 and the spur roller 32, and includes a receiving table 34 and a cutter 33 to cut the printing medium 2 into desired lengths to obtain pieces of printing medium (label pieces) 200. The cutter unit 35 cuts the printing medium 2 by moving the cutter 33 in the main scanning direction.

A discharge roller 36 is disposed on a downstream side of the cutter unit 35 in the feed direction A of the printing medium 2. A spur roller 37 is disposed to face the discharge roller 36. The label pieces 200 obtained by cutting the printing medium 2 by the cutter unit 35 are sent out to a discharge port 105 by the discharge roller 36 and the spur roller 37, and held between the discharge roller 36 and the spur roller 37.

Here, surfaces of the intermediate roller 31 and the discharge roller 36 to retain the label pieces 200 have been subjected to, for example, non-adhesive processing (processing to prevent adhesion of the adhesive faces) so that adhesive faces 2*b* of the label pieces 200 can separate from the surfaces. In such a case, each of the intermediate roller 31 and the discharge roller 36 may be made of separable material relative to that adhesive faces 2*b* of the label pieces 200.

In the image forming apparatus thus configured, to form an image on the printing medium 2, the roll body 4 is installed into the feed unit 101 and the printing medium 2 is pulled out while the pressure roller 24 is retracted to a position away from the conveyance roller 22.

Then, the printing medium 2 is caused to pass between the conveyance roller 22 and the pressure roller 24, the pressure roller 24 is moved in such a direction as to press the printing medium 2 and the protection belt 21, and the printing medium 2 and the protection belt 21 are sandwiched together between the conveyance roller 22 and the pressure roller 24.

Then, by driving the conveyance roller 22 for rotation, the printing medium 2 is conveyed with the adhesive face 2*b* being protected by the protection belt 21, and a desired image is formed by the recording heads 11 of the image forming unit 102. In this embodiment, the sheet feed amount is controlled based on a timing at which the printing medium 2 is detected by a sensor 9.

When the protection belt 21 is peeled off from the printing medium 2 on which the image is formed, only the printing medium 2 is sent to the discharge unit 104. The printing medium is cut at desired positions by the cutter unit 35 into the label pieces 200, and the label pieces 200 are retained between the discharge roller 36 and the spur roller 37 in such a manner that the label pieces 200 can be extracted from the discharge port 105 of the apparatus body 100.

Next, a detector to detect presence/absence and width of a printing medium 2 in the image forming apparatus according to an embodiment of this disclosure is described with reference to FIGS. 3 and 4.

Figure 3:
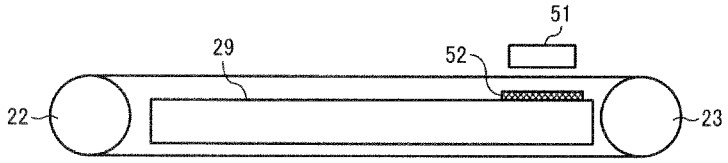
FIG. 3 is a side view of relative positions of a reflection member and a media sensor of a conveyance unit according to an embodiment of this disclosure.

FIG. 3 is a side view of relative positions of a reflection member and a media sensor of a conveyance unit according to an embodiment of this disclosure. FIG. 4 is a plan view of the conveyance unit of FIG. 3.

In this embodiment, the image forming apparatus has a media sensor 51 serving as a reflection-type photosensor to detect a printing medium 2. The media sensor 51 is disposed at a side face of the carriage 12.

Inside the loop of the protection belt 21, a reflection member 52 is disposed at a fixed portion, such a housing of a suction unit 29 including the suction fan 27. The reflection member 52 reflects incident light incoming from the media sensor 51 through the suction holes 21*a*.

The reflection member 52 is disposed at an area opposing an area scanned by the carriage 12 and detected by the media sensor 51.

Next, a media detecting operation in this embodiment is described with reference to FIG. 5.

The reflection rate of the reflection member 52 is set to be a reflection rate at which a sensor output equivalent to a sensor output obtained when the media sensor 51 reads a surface of the protection belt 21 is obtained. The phrase "the media sensor 51 reads" means that the media sensor 51 irradiates light from a light emitter of the reflection type photosensor constituting the media sensor 51, receives reflection light of the irradiated light with a light receiver, and obtains an output voltage (sensor output) according to the received light amount.

Figure 4:
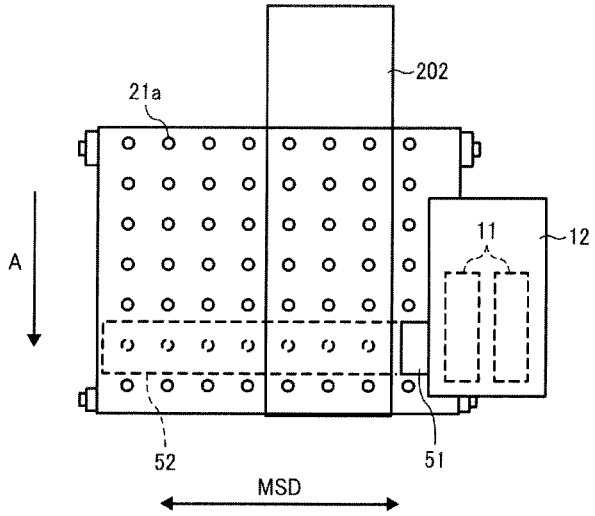
FIG. 4 is a plan view of the conveyance unit of FIG. 3.

In this case, as illustrated in FIG. 4, when a transparent tape 202 is mounted on and conveyed by the protection belt 21, the carriage 12 is moved in the main scanning direction indicated by arrow MSD in FIG. 4 to read the transparent tape 202 with the media sensor 51. As a result, for example, a sensor output illustrated in FIG. 5 is obtained.

Figure 5:
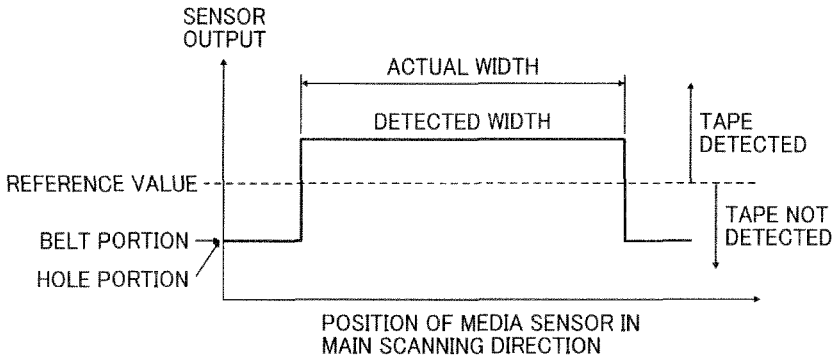
FIG. 5 is a chart of sensor output in media detecting operation according to an embodiment of the present disclosure.

In FIG. 5, a sensor output obtained when the surface of the protection belt 21 is read with the media sensor 51 is equal to a sensor output obtained when the surface of the reflection member 52 is read with the media sensor 51 via the suction holes 21*a*. When the transparent tape 202 is read with the media sensor 51, a greater sensor output (a greater incident light amount) is obtained than the sensor output obtained in reading the surface of the protection belt 21 or the reflection member 52.

Hence, a reference value of presence/absence of tape is set between the sensor output in the reading of the transparent tape 202 and the sensor output in the reading of the surface of the protection belt 21 or the reflection member 52. The presence/absence of the transparent tape 202 can be determined by comparing a sensor output of the media sensor 51 and the reference value of presence/absence of tape, thus allowing detection of the position of a leading end or the width of the transparent tape 202.

Even when the transparent tape 202 is conveyed with a conveyance belt, such as the protection belt 21 having the suction holes 21*a*, such a configuration can detect the width of the transparent tape 202 without influence of the suction holes 21*a*. Similarly, the leading end of the transparent tape 202 can be detected.

Here, a false detection in a comparative example having no reflection member 52 is described with reference to FIGS. 10 through 12.

Figure 11:
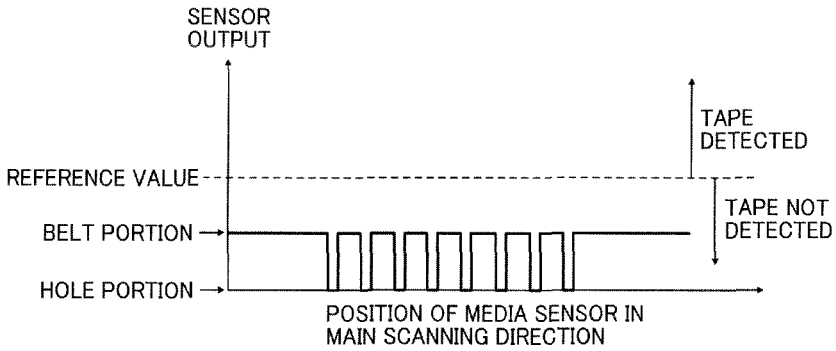
FIG. 11 is a chart of an example of sensor output obtained when a transparent tape is not present on the protection belt in the comparative example of FIG. 10.

For a configuration having no reflection member 52, since little reflection light is obtained from suction holes 21*a*, as illustrated in FIG. 11, a sensor output of the suction holes 21*a* is lower than a sensor output of the surface of the protection belt 21. In this state, any of the sensor output of the surface of the protection belt 21 and the sensor output of the suction holes 21*a* is lower than the reference value of presence/absence of tape, thus preventing false detection.

Figure 10:
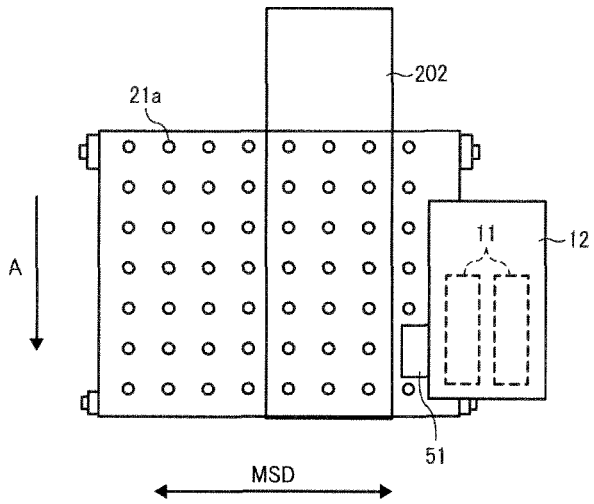
FIG. 10 is a plan view of a protection belt according to a comparative example in which a reflection rate at suction holes of the protection belt is lower than a reflection rate of a surface of the protection belt.
Figure 12:
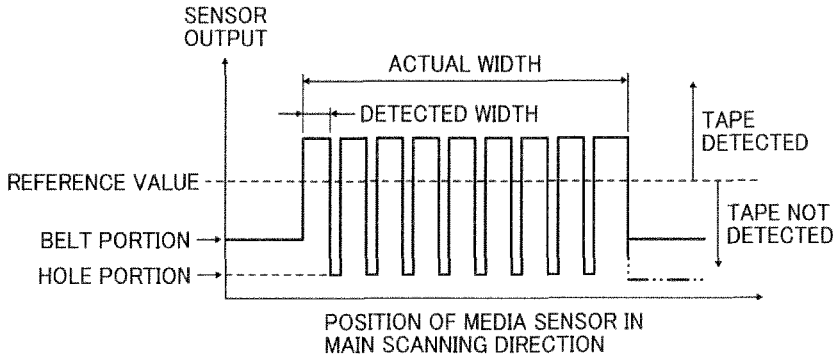
FIG. 12 is a chart of an example of sensor output obtained when a transparent tape is present on the protection belt in the comparative example of FIG. 10.

However, as illustrated in FIG. 10, if the transparent tape 202 is mounted on the protection belt 21 and detected by the media sensor 51, a sensor output of the media sensor 51 at a portion corresponding to the suction holes 21*a* is lower, as illustrated in FIG. 12, than a sensor output obtained when the surface of the protection belt 21 is directly read. This is because slight reflection light is obtained by reflection of the transparent tape 202 but no reflection is obtained from the suction holes 21*a*.

Therefore, when the media sensor 51 reads the suction holes 21*a* of the protection belt 21 through the transparent tape 202, the sensor output of the media sensor 51 is lower than the reference value of presence/absence of tape. As a result, it is detected (determined) that the transparent tape 202 is not present on the protection belt 21.

Consequently, the distance between adjacent ones of the suction holes 21*a* of the protection belt 21 is detected as the width of the transparent tape 202, thus causing false detection.

In FIG. 12, the sensor output of hole portion represents a sensor output at the suction holes 21*a* including the transparent tape 202, and the sensor output of belt portion represents a sensor output of the surface of the protection belt 21 not including the transparent tape 202.

Next, another comparative example in which a reflection rate of a reflection member 52 is eminently higher than a reflection rate of a surface of a protection belt 21 is described with reference to FIGS. 13 through 15.

Figure 14:
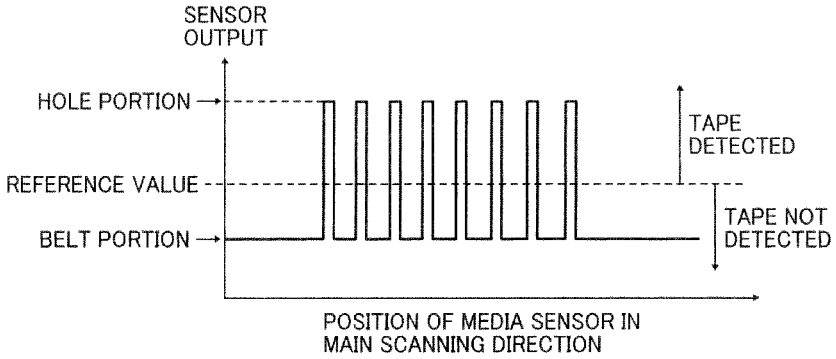
FIG. 14 is a chart of an example of sensor output obtained when a transparent tape is not present on the protection belt in the comparative example of FIG. 13.

In this comparative example, in a state in which a transparent tape 202 is present on the protection belt 21, as illustrated in FIG. 14, a sensor output of a portion corresponding to suction holes 21*a* is greater than a sensor output at a portion corresponding to the surface of the protection belt 21. Any of the sensor output of the portion corresponding to the suction holes 21*a* and the sensor output at the portion corresponding to the surface of the protection belt 21 is greater than the reference value of presence/absence of tape, thus preventing occurrence of false detection.

Figure 13:
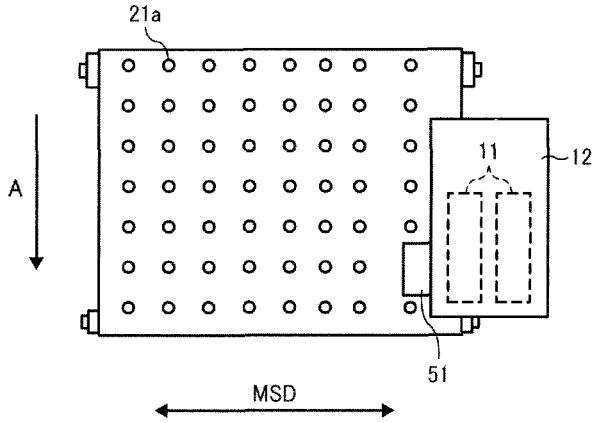
FIG. 13 is a plan view of a protection belt according to another comparative example in which a reflection rate at suction holes of a protection belt is eminently higher than a reflection rate of a surface of the protection belt.
Figure 15:
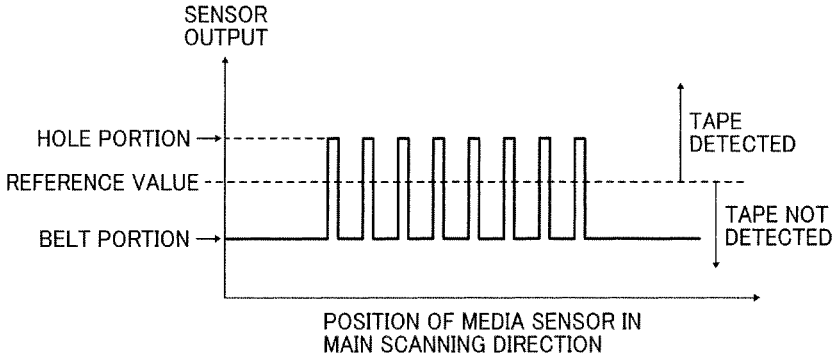
FIG. 15 a chart of an example of sensor output obtained when a transparent tape is present on the protection belt in the comparative example of FIG. 13.

However, in such a state, as illustrated in FIG. 13, when the surface of the protection belt 21 is read with a media sensor 51 with the transparent tape 202 being not present on the protection belt 21, as illustrated in FIG. 15, the sensor output of the media sensor 51 is higher than a sensor output obtained when the media sensor 51 reads the surface of the protection belt 21 at the portion corresponding to the suction holes 21*a*.

Accordingly, when the media sensor 51 reads the suction holes 21*a* of the protection belt 21, the sensor output of the media sensor 51 exceeds the reference value of presence/absence of tape. As a result, it is detected (determined) that the transparent tape 202 is present on the protection belt 21.

Consequently, despite the absence of the transparent tape 202 on the protection belt 21, a false detection of the presence of the transparent tape 202 occurs. Droplets are directly ejected onto the protection belt 21 to form an image on the protection belt 21, thus contaminating the protection belt 21 with ink.

As described above, even in the configuration having the reflection member 52, if the reflection rate of the reflection member 52 is eminently too high, the suction holes 21*a* of the protection belt 21 may cause false detection. In other words, even in the configuration in which the reflection member 52 is provided, if the sensor output of reflection light from the suction holes 21*a* is at the "presence of tape" side relative to the reference value of presence/absence of tape, the presence/absence of the transparent tape 202 cannot be correctly determined.

Hence, in this embodiment, the reflection member 52 is disposed inside the loop of the protection belt 21 to reflect incident light incoming through the suction holes 21*a*. Here, the reflection rate of the reflection member 52 is set to be a reflection rate at which, when the media sensor 51 receives reflection light at the portion corresponding to the suction holes 21*a* with the transparent tape 202 serving as a transparent recording medium not present on the protection belt 21, the sensor output of the media sensor 51 is lower than the reference value of presence/absence of tape, and when the media sensor 51 receives reflection light at the portion corresponding to the suction holes 21*a* with the transparent tape 202 present on the protection belt 21, the sensor output of the media sensor 51 is equal to or higher than the reference value of presence/absence of tape.

Thus, in the configuration of determining presence or absence of the transparent medium by comparing the predetermined media reference value with the sensor output, the presence or absence of the transparent tape 202 can be correctly determined in the portion corresponding to the suction holes 21*a*, thus preventing false detection of the media sensor employing a reflection-type photosensor.

In other words, in the configuration illustrated in FIGS. 10 through 12, in the state in which the transparent tape 202 present on the protection belt 21, the sensor output of the media sensor at the suction holes 21*a* is at the "absence of tape" side relative to the reference value of presence/absence of tape. As a result, the presence/absence of the transparent tape cannot be determined based on the sensor output of the media sensor at the suction holes 21*a*.

In the configuration illustrated in FIGS. 13 to 15, in the state in which the transparent tape 202 is not present on the protection belt 21, the sensor output of the media sensor at the suction holes 21*a* is at the "presence of tape" side relative to the reference value of presence/absence of tape. As a result, the presence/absence of the transparent tape cannot be determined based on the sensor output of the media sensor at the suction holes 21*a*.

By contrast, in this embodiment, the reflection rate of the reflection member 52 is set to be the above-described reflection rate. Such a configuration can correctly determine the presence/absence of a transparent printing medium on the belt member having the suction holes, with the reflection-type photosensor.

Here, the reflection rate of the reflection member 52 is described with reference to FIG. 6.

First, when the media sensor 51 reads the suction holes 21*a* of the protection belt 21 with the transparent tape 202 being not present on the protection belt 21 and the sensor output of the media sensor 51 exceeds the reference value of presence/absence of tape, as described above, false detection occurs of incorrectly determining that the transparent tape 202 would be present on the protection belt 21.

Hence, the reflection rate of the reflection member 52 is set to be a reflection rate at which, when the media sensor 51 reads the suction holes 21*a* of the protection belt 21 with the transparent tape 202 being not present on the protection belt 21, the sensor output of the media sensor 51 does not exceed the reference value of presence/absence of tape.

By contrast, in a case in which the reflection rate of the suction holes 21*a* of the protection belt 21 is lower than the reflection rate of the surface of the protection belt 21, as described above, even if the transparent tape 202 is present on the protection belt 21, the sensor output of the media sensor 51 may be lower than the reference value of presence/absence of tape. In such a case, a false detection occurs of incorrectly determining that the transparent tape 202 would not be present on the protection belt 21.

Hence, in this embodiment, the reflection rate of the reflection member 52 is set to be a reflection rate at which, when the media sensor 51 reads the suction holes 21*a* of the protection belt 21 with the transparent tape 202 being present on the protection belt 21, the sensor output of the media sensor 51 does not fall below the reference value of presence/absence of tape.

At this time, if the reflection rate of the suction holes 21*a* of the protection belt 21 is equivalent to the reflection rate of the surface of the protection belt 21, when the media sensor 51 reads the suction holes 21*a* of the protection belt 21 with the transparent tape 202 being present on the protection belt 21, the sensor output of the media sensor 51 does not fall below the reference value of presence/absence of tape.

Hence, the reflection rate of the reflection member 52 is set to be between the reference value of presence/absence of tape and the sensor output obtained when the media sensor 51 reads the surface of the protection belt 21.

In other words, when the presence or absence of a transparent printing medium is determined by comparing the sensor output of the reflection-type photosensor (media sensor)

with the predetermined reference value for determining the presence or absence of printing medium, the reflection rate of the reflection member is set to satisfy the following two conditions 1) and 2).

1) When the media sensor receives reflection light at the positions of the suction holes with the transparent printing medium not being present on the belt member, the sensor output of the media sensor is lower than the sensor output corresponding to the reference value of presence/absence of printing medium.

2) When the media sensor receives reflection light at the positions of the suction holes with the transparent printing medium being present on the belt member, the sensor output of the media sensor is not lower than the sensor output corresponding to the reference value of presence/absence of printing medium.

Such a configuration can reliably prevent the false detection.

Figure 6:
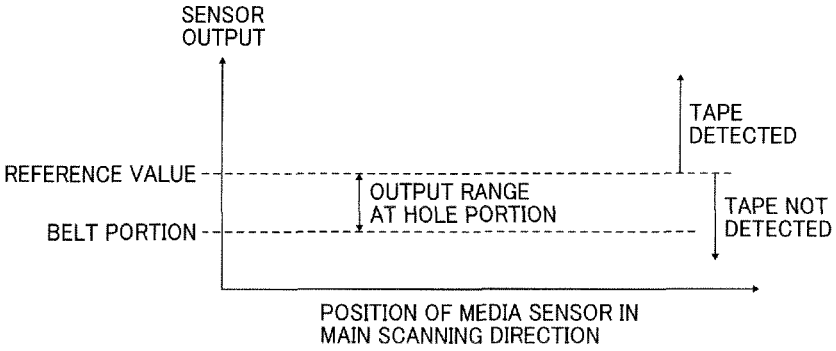
FIG. 6 is a chart of an example of setting of a reflection rate of the reflection member.

Here, when the above-described condition 2) is satisfied, the sensor output obtained when the media sensor 51 reads the suction holes 21*a* may not be necessarily between the reference value of presence/absence of tape and the sensor output obtained when the media sensor 51 reads the protection belt 21 as illustrated in FIG. 6.

In other words, when the reflection rate of the reflection member is set to be the above-described reflection rate, the sensor output obtained when the media sensor 51 receives reflection light at the positions of the suction holes 21*a* with a transparent printing medium being not present on the belt member can be lower than the sensor output obtained when the media sensor 51 receives reflection light from the surface of the belt member. Alternatively, by contrast, the sensor output obtained when the media sensor 51 receives reflection light at the positions of the suction holes 21*a* with a transparent printing medium being not on the belt member can be higher than the sensor output obtained when the media sensor 51 receives reflection light from the surface of the belt member.

Figure 7:
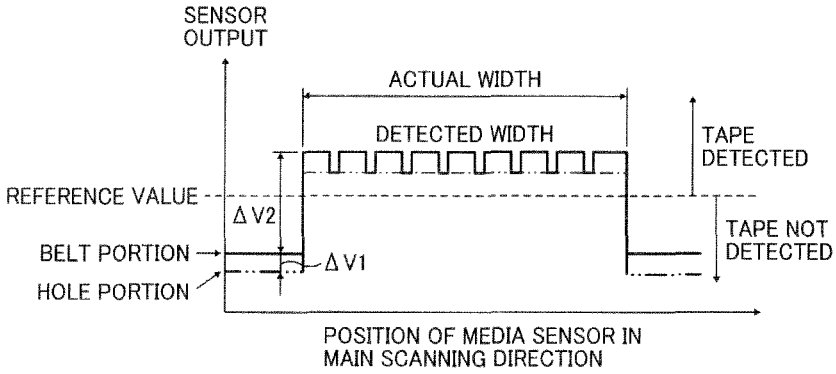
FIG. 7 is a chart of another example of setting of the reflection rate of the reflection member.

For example, as illustrated in FIG. 7, when the media sensor 51 reads the suction holes 21*a* of the protection belt 21 with the transparent tape 202 being present on the protection belt 21, it is sufficient that the sensor output of the media sensor 51 does not fall below the reference value of presence/absence of tape.

Thus, if the above-described condition 2) is satisfied, the reflection rate of the reflection member 52 can be set to be a reflection rate at which, when the media sensor 51 receives reflection light at the positions of the suction holes 21*a* with a transparent printing medium being not present on the belt member, the sensor output is lower than the sensor output obtained when the media sensor 51 receives reflection light from the surface of the belt member.

In other words, as illustrated in FIG. 7, the reflection rate of the reflection member 52 is set so that a difference $\Delta V1$ between the sensor output obtained when the media sensor 51 receives reflection light from the surface of the protection belt 21 and the sensor output obtained when the media sensor 51 receives reflection light from the reflection member 52 is lower than a difference $\Delta V2$ between the sensor output obtained when the media sensor 51 receives reflection light from the surface of the protection belt 21 and the sensor output obtained when the media sensor 51 receives reflection light with the transparent tape 202 present on the protection belt 21.

Thus, the reference value of presence/absence of tape can be set so that, as illustrated in FIG. 7, even if the sensor output falls in a portion of the suction holes 21*a*, the sensor output is the reference value of presence/absence of tape or greater, thus allowing reliable detection of the transparent tape.

Figure 8:
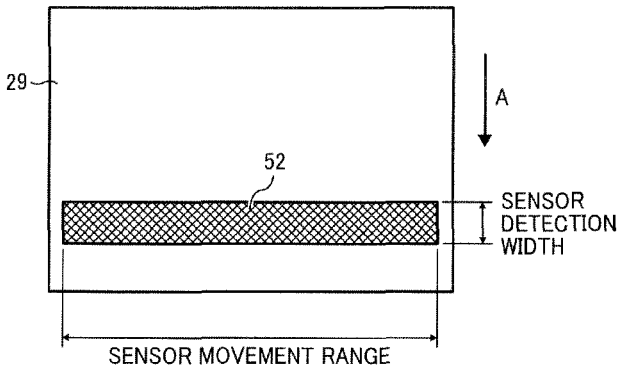
FIG. 8 is a plan view of a setting area of the reflection member according to an embodiment of this disclosure.

Next, a region of installation of the reflection member according to an embodiment of this disclosure is described with reference to FIG. 8.

In this embodiment, the reflection member 52 is disposed only at an area corresponding to a detection area of the media sensor 51. In other words, as illustrated in FIG. 8, the reflection member 52 has a width corresponding to a detection width of the media sensor 51 in a media feed direction indicated by arrow A in FIG. 8 and a length corresponding to a movement range of the media sensor 51.

Such a configuration minimizes the reflection member 52, thus allowing cost reduction.

Figure 9:
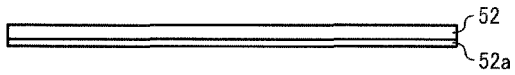
FIG. 9 is a plan view of an example of installation of the reflection member according to an embodiment of this disclosure.

Next, a method of installing the reflection member according to an embodiment of this disclosure is described with reference to FIG. 9.

In this embodiment, the reflection member 52 includes an adhesive layer 52*a*, and is separably attached on, for example, a suction unit 29. Alternatively, the reflection member 52 may be removably disposed by, e.g., screw fastening or snap-fit.

As described above, providing the reflection member 52 in a replaceable manner facilitates maintenance, such as replacement or cleaning, when the reflection member 52 is contaminated with, e.g., mist.

In the above-described embodiments, the conveyance device to convey the printing medium while protecting the adhesive face with the protection belt has been described. However, the conveyance device is not limited to the above-described structure. For example, in other embodiments, the conveyance device may have the following structures.

(1) An image is formed on an adhesive face of a printing medium, and the printing medium is conveyed with a media face of the printing medium supported on a conveyance belt.
(2) A printing medium without an adhesive face is conveyed by a conveyance belt.

In this disclosure, the term "image formation" includes providing not only meaningful images such as characters and figures but meaningless images such as patterns to the medium (in other words, the term "image formation" also includes only causing liquid droplets to land on the medium).

In addition, the term "image forming apparatus" include both a serial-type image forming apparatus and a line-type image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image forming device to form an image on a printing medium;

a belt member movable to circulate, the belt member including plural suction holes to attract the printing medium onto the belt member;

a reflection-type photosensor to detect the printing medium on the belt member; and a reflection member to reflect light from the reflection-type photosensor through the suction holes, the reflection member disposed inside the belt member, wherein whether or not a transparent printing medium is present on the belt member is determined by comparing a sensor output of the reflection-type photosensor with a predetermined reference value of presence and absence of the printing medium, and wherein the reflection member has a reflection rate at which, when the reflection-type photosensor receives reflection light at positions of the suction holes with the transparent printing medium being not present on the belt member, the sensor output of the reflection-type photosensor is lower than the predetermined reference value, and when the reflection-type photosensor receives reflection light at the positions of the suction holes with the transparent printing medium being present on the belt member, the sensor output of the reflection-type photosensor is equal to or greater than the predetermined reference value.

2. The image forming apparatus of claim 1, wherein, when the reflection-type photosensor receives the reflection light at the positions of the suction holes with the transparent printing medium being not present on the belt member, the sensor output of the reflection-type photosensor is lower than when the reflection-type photosensor receives reflection light from a surface of the belt member.

3. The image forming apparatus of claim 1, wherein, when the reflection-type photosensor receives the reflection light at the positions of the suction holes with the transparent printing medium being not present on the belt member, the sensor output of the reflection-type photosensor is higher than when the reflection-type photosensor receives reflection light from a surface of the belt member.

4. The image forming apparatus of claim 1, wherein the reflection member has a size corresponding to an area detected by the reflection-type photosensor.

5. The image forming apparatus of claim 1, wherein the reflection member is replaceably disposed inside the belt member.

6. An image forming apparatus, comprising:

an image forming device to form an image on a printing medium;

a belt member movable to circulate, the belt member including plural suction holes to attract the printing medium onto the belt member;

a reflection-type photosensor to detect the printing medium on the belt member; and a reflection member to reflect light from the reflection-type photosensor through the suction holes, the reflection member disposed inside the belt member, wherein a difference between a sensor output of the reflection-type photosensor obtained when the reflection-type photosensor receives reflection light from a surface of the belt member and a sensor output of the reflection-type photosensor obtained when the reflection-type photosensor receives reflection light from the reflection member is lower than a difference between the sensor output of the reflection-type photosensor obtained when the reflection-type photosensor receives the reflection light from the surface of the belt member and a sensor output of the reflection-type photosensor obtained when the reflection-type photosensor receives reflection light with the transparent printing medium being present on the belt member.

7. The image forming apparatus of claim 6, wherein the reflection member has a size corresponding to an area detected by the reflection-type photosensor.

8. The image forming apparatus of claim 6, wherein the reflection member is replaceably disposed inside the belt member.

* * * * *